343-700 MS AU 256 EX
10/3/78 OR 4,118,706

United States Patent [19]

Kerr

[11] 4,118,706

[45] Oct. 3, 1978

[54] MICROSTRIP-FED PARASITIC ARRAY

[75] Inventor: John L. Kerr, Neptune, N.J.

[73] Assignee: The United States of America as represented by the Secretary of the Army, Washington, D.C.

[21] Appl. No.: 838,045

[22] Filed: Sep. 29, 1977

[51] Int. Cl.[2] ..... H01Q 1/38; H01Q 19/00; H01Q 1/48

[52] U.S. Cl. ..... 343/700 MS; 343/833; 343/846

[58] Field of Search ..... 343/700 MS, 725, 830, 343/833, 846

[56] References Cited

U.S. PATENT DOCUMENTS

| | | | |
|---|---|---|---|
| 3,508,278 | 4/1970 | Ehrenspeck | 343/833 |
| 3,573,831 | 4/1971 | Forbes | 343/700 MS |
| 4,051,477 | 9/1977 | Murphy et al. | 343/700 MS |
| 4,060,810 | 11/1977 | Kerr et al. | 343/700 MS |
| 4,070,676 | 1/1978 | Sanford | 343/700 MS |

*Primary Examiner*—Alfred E. Smith
*Assistant Examiner*—Harry E. Barlow
*Attorney, Agent, or Firm*—Nathan Edelberg; Sheldon Kanars; Bernard Franz

[57] ABSTRACT

A multi-director parasitic array attached at the center of a microstrip antenna design to provide a simple, low cost, efficient feed.

4 Claims, 5 Drawing Figures

MICROSTRIP-FED PARASITIC ARRAY

The invention described herein may be manufactured and used by or for the Government for governmental purposes without the payment of any royalties thereon or therefor.

FIELD OF THE INVENTION

This invention relates to feed techniques for multi-director parasitic arrays and, more particularly, to the utilization of the microstrip antenna design described in U.S. Pat. No. 4,060,810 to improve the manner of energizing parasitic arrays.

BACKGROUND OF THE INVENTION

As is well known and understood, the conventional feed for energizing a multi-director parasitic array employs a cylindrical dipole with slotted cylinder balun and a parasitic reflector. Such conventional feed, however, is both difficult and expensive to make, because of the time consuming precision machine work involved. Besides being critical electrically — held to close tolerances in order to operate at the desired frequency — the feed also tends to be weak mechanically — due in part to the slotted cylinder configuration. Additionally, the arrangement requires a degree of maintenance and weatherproofing so as to prevent against moisture penetrating the area of the balun openings.

SUMMARY OF THE INVENTION

As will become clear hereinafter, the multi-director parasitic array of the present invention is fed utilizing microstrip antenna techniques as are described in the U.S. Pat. No. 4,060,810, filed Oct. 4, 1976, and assigned to the same assignee as is this instant invention. As is there described, a microstrip antenna is a printed circuit device in which the radiating element is typically a rectangular patch of metal etched on one side of a dual-clad circuit board, with the size of the element being dependent upon the resonant frequency desired and upon the dielectric constant of the circuit board material. As is also there described, different and improved operation could be had if a central portion of the etched metal element were removed. In accordance with the present invention, the boom of a multi-director parasitic array is attached at the center of that area in providing a simpler, less expensive, and more efficient feed then has been previously possible.

BRIEF DESCRIPTION OF THE DRAWINGS

These and other features of the present invention will be more clearly, understood from a consideration of the following description, taken in connection with the accompanying drawings, in which.

DETAILED DESCRIPTION OF THE DRAWINGS

Figure 1:
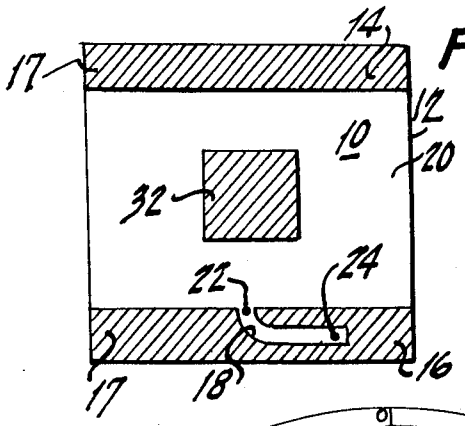
FIG. 1 shows a microstrip antenna embodying the teachings of the U.S Pat. No. 4,060,810.

In FIG. 1, the microstrip antenna 10 of U.S. Pat. No. 4,060,810 is shown as comprising a circuit board 12, the back side of which (not shown) is clad entirely of metal material, typically copper. In conventional construction, the front side of the circuit board is clad of like material, except in the areas 14 and 16, where the metal is etched away to reveal the dielectric material 17 underneath. A section of metal 18 extends from the rectangular metal patch 20 so formed, to operate as a microstrip transformer in matching the impedance at the input to the patch 22 to the impedance at the signal input jack 24, usually the output from a coaxial cable coupled through the back side of the circuit board 12.

In accordance with the invention described in U.S. Pat. No. 4,060,810 the resonant frequency of that described radiator decreases if a central portion of the rectangular metal patch 20 is removed. For example, it was noted that if a 1-inch square area were removed at the center of the circuit board 12, then the resonant frequency would be lowered by slightly in excess of 9%, as compared with an unloaded microstrip antenna. It was further described how, if the central area, shown as 32 in the present FIG. 1, were so removed as to include the dielectric material beneath it and the copper cladding on the back side of the board 12 as well (thereby resulting in a 1-inch square hole completely through the circuit board 12), then the resonant frequency of the microstrip antenna would be lowered by approximately another 1%.

In accordance with the present invention, the boom of the multi-director parasitic array passes through this central hole 32, to be secured in locking manner to the back side of the circuit board 12 so as to be maintained in proper orientation with respect to it. The signal input for the multi-director array is then via the jack 24.

Figure 2:
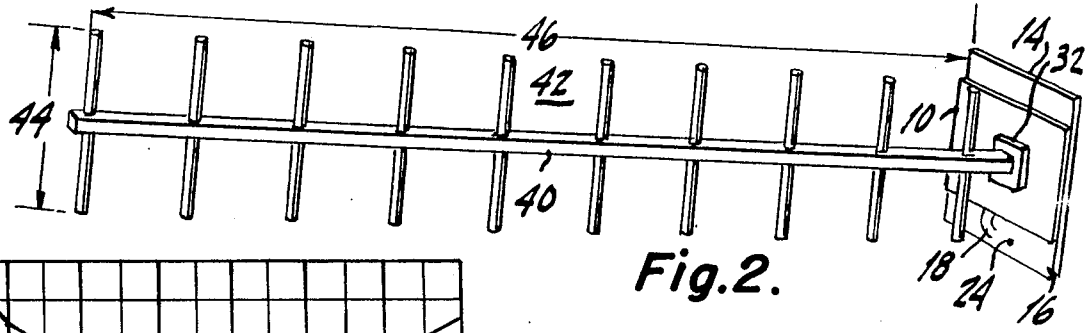
FIG. 2 illustrates the attachment of a multi-director parasitic array to the microstrip antenna of FIG 1, according to the present invention.

Such combination is shown in FIG. 2, where for ease of understanding, the boom, shown by the reference numeral 40, passes through only a central portion of the patch area removed 32, the cross-sectional area of the boom 40 being less than the 1-inch square area of the card removed. In one construction of the invention, a ten element array 42 was employed, with the individual director lengths 44 being approximately 3.410 inches, with the overall length 46 being approximately 18.5 inches — and such that when constructed of aluminum, the array 42 had an approximate weight of one-half pound. The circuit board 12, furthermore, was constructed some five inches on a side, clad with copper 1½ mils thick and overlying a ⅛ inch thick Duroid dielectric.

Figure 3:
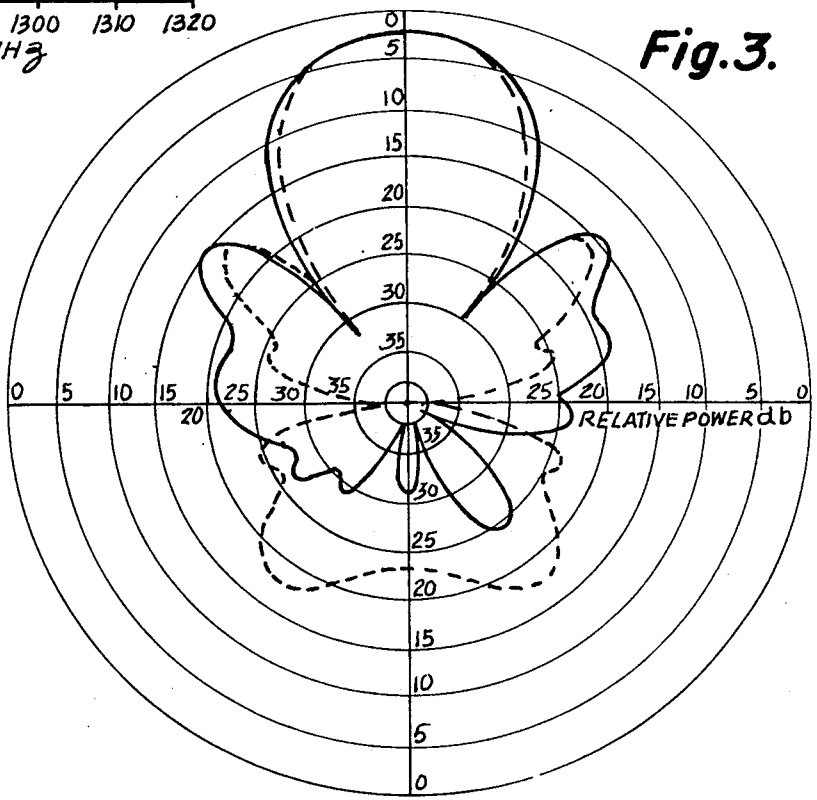
FIGS. 3 and 4 show radiation patterns obtained using conventional feed techniques and the microstrip feed technique of the invention.
Figure 4:
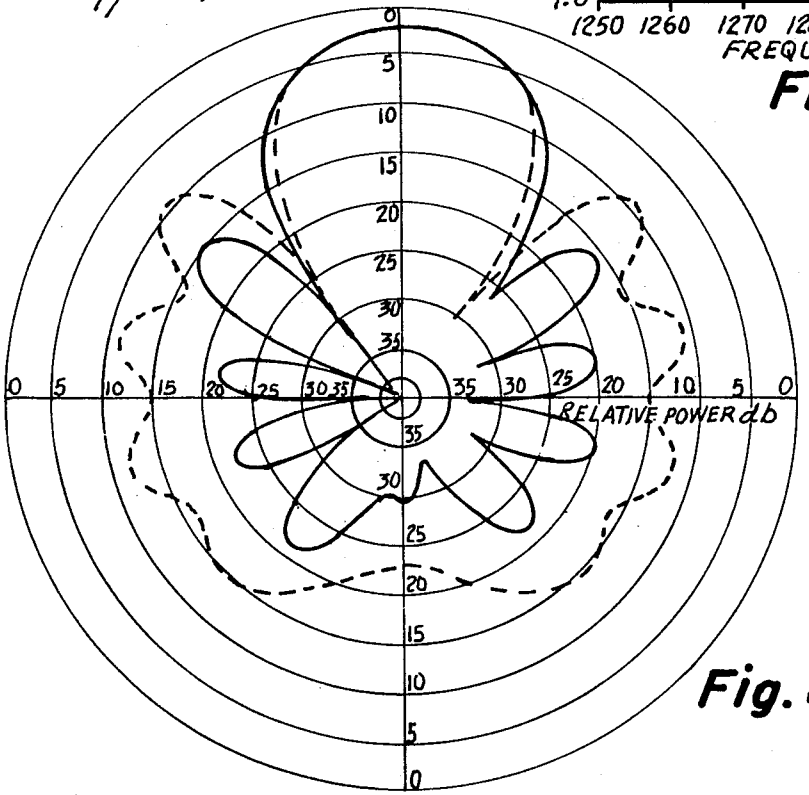

The "dashed" radiation patterns A of FIGS. 3 and 4 illustrate the E- and H- plane patterns, respectively, for the ten element multi-director parasitic array using a conventional dipole fed, slotted cylinder balun antenna feed. The "solid" radiation patterns B of FIGS. 3 and 4 show the same E- and H- plane patterns with the microstrip feed of the present invention. Considering the E-plane patterns of FIG. 3, it will be seen that the microstrip feed configuration exhibits about 1 dB higher first sidelobes and does not have the deep nulls at ± 90° — but it does have lower back radiation than does the conventional feed. The H- plane patterns of FIG. 4, on the other hand, show significantly lower sidelobes and back radiation for the microstrip feed configuration, as compared with the conventional feed arrangement.

Figure 5:
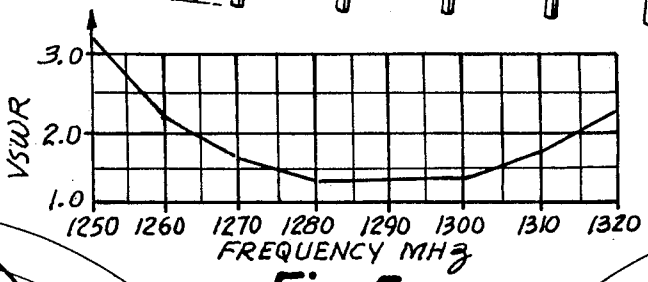
FIG. 5 is a graph illustrative of the performance of the feed design of this invention.

Additionally, the gain with the microstrip configuration was determined to be approximately 1.5 dB higher such that, together with the improved sidelobe and back radiation characteristics, the microstrip feed arrangement provided significantly improved performance even though the beam widths in both the E- and H-planes were slightly wider. The voltage-standing-wave-ratio graph of FIG. 5 for the invention also indicates a quite acceptable performance over an L-band frequency range of interest.

While there has been described what is considered to be a preferred embodiment of the present invention, it will be readily apparent to those skilled in the art that modifications may be made without departing from the teachings herein of using a microstrip antenna of the type described in the U.S. Pat. No. 4,060,810 as the means for feeding multi-director parasitic array. For example, whereas the configuration of FIG. 2 shows a single frequency arrangement, dual-polarized, circular polarized and dual frequency embodiments can be obtained using the microstrip feed technique here described. Also, the area of the central patch removed 32 could be adjusted to more nearly match the cross sectional area of the boom 40 passing through it than is illustrated by the prototype version of the invention here indicated. For at least such reasons, therefore, reference should be had to the claims appended hereto in determining the scope of this invention.

I claim:

1. In an antenna, the combination comprising:

a circuit board of dielectric material having a metallic ground plane on one side thereof;

a radiating element in the form of a patch of metal etched on the opposite side of said board, said patch being continuous thereacross except for the removal of a portion in the central region thereof;

a multi-director parasitic array affixed to said circuit board at said central region;

and means for supplying an input signal to said radiating element for energizing said parasitic array.

2. The combination of claim 1 wherein said multi-director parasitic array includes a support boom, and wherein said support boom is affixed to said circuit board at said central region of said patch.

3. The combination of claim 2 wherein said circuit board and metallic ground plane are also continuous, except for the removal of a portion thereof substantially co-extensive with the removal of said patch portion etched thereupon, and wherein said support boom is affixed to said circuit board via passing through the discontinuous regions of said circuit board and ground plane thus formed, to be secured to said circuit board at the metallic ground plane side of said board.

4. The combination of claim 3 wherein the patch portion, circuit board portion and ground plane portion removed are of a cross-section substantially identical to that of said support boom where passing through said discontinuous regions of said circuit board and ground plane thus formed.

* * * * *